United States Patent [19]

Sibley et al.

[11] Patent Number: 4,495,578

[45] Date of Patent: Jan. 22, 1985

[54] MICROPROCESSOR BASED OVER/UNDER SPEED GOVERNOR

[75] Inventors: Henry C. Sibley, Adams Basin; David B. Rutherford, Jr., Scottsville, both of N.Y.

[73] Assignee: General Signal Corporation, Stamford, Conn.

[21] Appl. No.: 313,926

[22] Filed: Oct. 22, 1981

[51] Int. Cl.[3] ..... B60T 8/02

[52] U.S. Cl. ..... 364/426; 246/23; 246/62; 246/167 R; 246/182 R

[58] Field of Search ..... 246/182 C, 182 A, 182 R, 246/182 B, 167 R, 23, 62, 187 R, 187 B; 364/426

[56] References Cited

U.S. PATENT DOCUMENTS

| | | | |
|---|---|---|---|
| 3,519,805 | 7/1970 | Thorne-Booth | 364/426 |
| 3,749,994 | 7/1973 | Matty | 318/563 |
| 3,800,139 | 3/1974 | Clark | 246/182 C |
| 3,934,125 | 1/1976 | Macano | 364/426 |
| 3,974,992 | 8/1976 | Matty | 246/187 B X |
| 4,142,700 | 3/1979 | Ubel | 246/182 B |
| 4,181,849 | 1/1980 | Sibley | 364/900 X |
| 4,209,828 | 6/1980 | Anderson et al. | 246/182 R X |
| 4,279,395 | 7/1981 | Boggio et al. | 246/187 B X |
| 4,459,668 | 7/1984 | Inoue et al. | 364/426 |

FOREIGN PATENT DOCUMENTS

| | | | |
|---|---|---|---|
| 2711718 | 9/1978 | Fed. Rep. of Germany | 246/187 R |
| 124816 | 10/1978 | Japan | 246/187 R |
| 51110 | 4/1979 | Japan | 246/187 R |

*Primary Examiner*—J. V. Truhe
*Assistant Examiner*—Bentsu Ro
*Attorney, Agent, or Firm*—Pollock, Vande Sande & Priddy

[57] ABSTRACT

A vehicle carried profile generator generates a speed profile to control a vehicle governor at the transition from a higher to lower speed limit. The speed profile is calculated and checked to ensure it starts at a valid speed limit, continually decreases and is above a wayside speed limit. The governor is modified or controlled to inhibit brake application or a requirement for a brake application so long as actual speed is below profile speed.

17 Claims, 12 Drawing Figures

TIME-BASED SPEED LIMIT PROFILE GENERATION

DISTANCE-BASED SPEED LIMIT PROFILE GENERATION

SPEED LIMIT TRANSITION CHECK

FIG. 5c
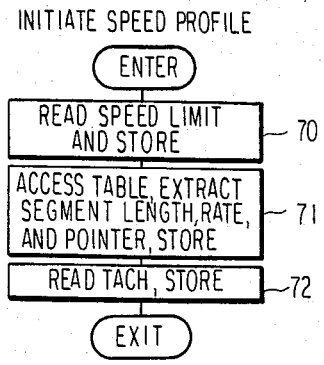
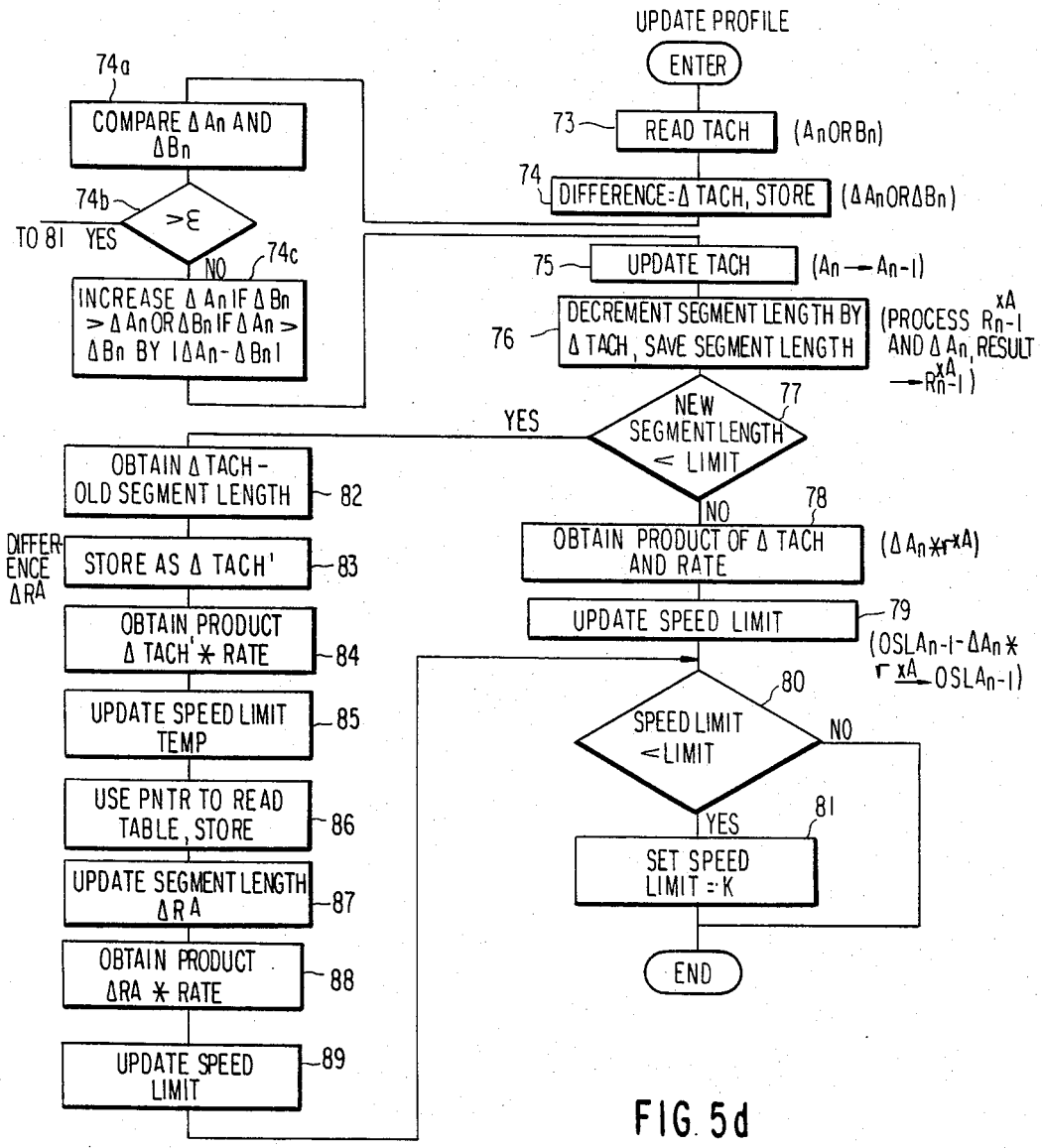
FIG. 5d

SPEED LIMIT VALIDATION

MICROPROCESSOR BASED OVER/UNDER SPEED GOVERNOR

BACKGROUND OF THE INVENTION

Present day automatic, and semi-automatic operation of railroad vehicles divides the railroad track into units called blocks. Wayside circuitry is capable of resolving vehicle location to within a block. To provide vehicle carried apparatus (or an operator, if one is present) with traffic information, other wayside circuitry transmits an indication of the distance between a vehicle and the immediately preceding vehicle. This information is coded so as to represent, at least, a speed limit. The speed limit is computed such that it is always possible for the following vehicle to stop within the unoccupied distance between vehicles. Actually typical operation has a substantial safety factor since the speed limit is calculated on the assumption that the following vehicle is about to exit from the block, and thus, the assumed clear space between vehicles is a limiting case which only approaches the reality as the following vehicle approaches a block boundary.

The foregoing analysis is particularly significant in examining typical vehicle operation as it transits or crosses a block boundary. As the vehicle crosses the block boundary the wayside circuitry subtracts an entire block length from the clear distance between vehicles, although at that instant of time there actually exists the greatest safety factor, since the assumed clear distance between vehicles is less than the actual clear distance between vehicles by the length of the block. This typical operation has, for many years, been beset by a problem which manifests itself at the block boundary; typically, the allowable speed limit in the block being entered may be lower (a lower speed limit) than the speed limit (the higher speed limit) in the block being exited. Thus, a train which was quite safely being operated near the higher speed limit can be abruptly placed into an overspeed condition as it crosses the block boundary as the speed limit drops to the lower speed limit.

Typical vehicle carried apparatus includes a governor; the governor has at least two input signals, one representing actual vehicle speed, and the other representing the wayside speed limit; and the governor continually compares these. If actual speed exceeds the speed limit an overspeed condition is detected. So long as an overspeed conditions is not detected, the governor does not (typically) interfere with operation of the vehicle. However, when an overspeed condition is detected the governor may automatically impose a brake application; or signals the vehicle operator that he must impose a brake application, and if he fails to so impose a brake application, the governor may then thereafter automatically impose a brake application. Regardless of the specific operating procedure, because of the ensuing braking operation the governor loses control of the rate of which the vehicle is brought under the new speed limit. Either the brake application brings the vehicle under speed sooner than is actually required by the actual clear distance between vehicles, or the vehicle does not decelerate quickly enough. Because block length and associated speed limits are calculated based on worst case analyses it is apparent that a higher speed limit could be tolerated at the entering end of a block than is now possible under present day operating procedures and with present day operating apparatus.

Another application which generates a similar problem is that of station stopping. Currently, as a vehicle is brought into a station under manual control the only apparatus enforced speed limit is a low speed limit of say 15 to 35 miles per hour. Even automatic station stopping apparatus employs a non-zero speed limit. Since the speed limit is non-zero, vehicle headway must allow for the possibility of the vehicle overrunning the station in the worst case.

Both of these (and other) situations could be improved by the generation on board the vehicle of a speed limit which transited smoothly from an upper to a lower speed limit. To alleviate these problems the speed profile must have two characteristics; firstly, it gradually decreases, say from a first or higher speed limit when the profile generation apparatus is initiated, to a lower or zero speed limit at the termination of the speed profile generation. The second characteristic is that of vitalness; that is, the speed profile can be depended upon to ensure vehicle safety.

The prior art does evidence a vehicle carried apparatus to generate a profile speed limit, one that decreases with time and/or distance. However, typically as is illustrated in Macano, U.S. Pat. No. 3,934,125, the profile speed limit is not vital in that it is associated with a higher speed limit on which safety is predicated. Such an arrangement would, of course, not at all meet the needs of the situation referred to above. What is required, is a vital speed profile which can be depended upon for safety. For example, one that could be fed to the governor, along with the wayside generated speed limit, and safely allow the governor to control the vehicle to be at a speed below the higher of the two (speed profile or wayside generated) limits.

Reference to FIGS. 1-3 will help explain the deficiencies is presently used equipment and the result of using either of the two different embodiments of the invention.

FIG. 1 illustrates a profile of vehicle speed versus some monotonically increasing parameter such as time and/or distance. The horizontal lines in FIG. 1 represent both an "old" speed limit and a "new" speed limit. Since the problems sought to be overcome arise from a decrease in speed limit, the relationship shown in FIG. 1 between the "old" and "new" speed limits is one wherein the "old" speed limit is the higher of the two. Besides these speed limits FIG. 1 also represents actual vehicle velocity. In FIG. 1 the "old" speed limit is effective for values of the abscissa parameter less than $A_1$ and the "new" speed limit is effective for values of the abscissa greater than $A_1$. This is an accurate portrayal of typical operating conditions inasmuch as the vehicle carried apparatus in many cases has no warning of an impending reduction in speed limit as occurs at the value of the abscissa corresponding to $A_1$. Conventional vehicle carried apparatus would (either manually, semi-automatically or automatically) control the actual vehicle speed to lie near but below the "old" speed limit in the region governed by that limit. However at the transition (that is the values of the abscissa near to but larger than $A_1$) the vehicle is overspeed. Under those circumstances the equipment imposes a braking force or requires the operator to apply the vehicle breaks to bring the actual vehicle speed down, as is shown in FIG. 1. At the time when the actual vehicle speed drops below the "new" speed limit (at an abscissa value corresponding to $A_2$) the brake application may be removed (either manually or automatically) and the same vehicle carried apparatus will control the speed of the vehicle at but slightly below the "new" speed limit. It is a goal of the invention to smooth the transition from old to new speed limits so that the new speed limit is enforced only at the exit end of the block whose entrance is at $A_1$. In many cases the brake application can be avoided altogether. In other situations the deceleration can be reduced.

FIGS. 2 and 3, on the other hand show operation in accordance with the present invention. More particularly, FIG. 2 shows speed limit on a vertical axis, and particularly noted on that axis are a "old" speed limit and a "new" speed limit, wherein the transition between the old and the new limits occurs at a value of the abscissa $A_1$. In the case of FIG. 2 the abscissa represents time, the solid line represents a speed limit profile generated by vehicle carried apparatus at a transition from a higher to a lower speed limit. In the case of the operation shown in FIG. 2, time is broken up into a number of segments. $R_1$–$R_4$. Associated with each segment is a speed reduction rate (for the case of FIG. 2 it is $r_n$ in miles per hour/second). For each segment the speed profile provides a speed limit corresponding to the speed limit at the beginning of the segment less the product of the associated rate ($r_n$ where n identifies the segment) multiplied by the current extent of travel through the segment. Thus as is shown in FIG. 2 velocity reduction is minimal in the first segment, and it increases sequentially through the second, third and fourth segments. This increase in the velocity reduction rate is indicated by the increase in slope of the line representing the speed profile. Vehicle carried apparatus is provided with the speed profile so that the vehicle speed is (manually, semi-automatically or automatically) controlled to lie near but below the effective speed profile.

FIG. 3 is a similar representation except that now the abscissa represents distance rather than time and thus the four different segments represent vehicle travel rather than time periods. Similarly, the reduction rate (r) is measured in miles per hour/foot.

It is significant to note that both in FIGS. 2 and 3, notwithstanding that the wayside imposed speed limit (the new speed limit), is below the actual train speed for most of the durations shown in FIGS. 2 and 3, the vehicle is not necessarily subjected to braking (either equipment applied or an operator required application) if the vehicle speed is below the speed profile. This operation is a significant feature of the invention in allowing the vehicle operation to proceed even though the vehicle speed exceeds a wayside imposed speed limit, so long as vehicle speed is less than a vehicle generated speed profile.

In accordance with the invention the vehicle carries a transitional speed limit (profile) generator which is initiated into operation when vehicle carried apparatus detects a wayside imposed speed limit transition from a first or higher speed limit to a second or lower speed limit. In general, the transitional speed limit or speed limit profile comprises a series of monotonically decreasing speed limits which is iteratively generated in the following fashion:

Beginning at an old or higher speed limit and depending on the independent parameter (either distance or time, for example) obtain a product between an effective velocity reduction rate with the change in the independent parameter;

Reduce the initial speed limit by the product obtained above;

Repeat the foregoing steps until either a segment (of time or distance) over which the rate is effective expires or the resulting speed limit is found to be below the newly imposed or lower speed limit.

It is a significant feature of the invention that the foregoing is achieved without compromising vehicle safety.

SUMMARY OF THE INVENTION

Thus, in accordance with one aspect, the invention provides vehicle carried control apparatus to control vehicle motion in the transition from a first speed limit to a second, lower, speed limit comprising:

signal receiving means for receiving and registering wayside imposed speed limits;

vehicle speed measuring means for producing a signal representative of vehicle speed;

governor means responsive to said signal receiving means and to said vehicle speed measuring means for imposing a braking force or a requirement for a braking operation on said vehicle if said vehicle speed is greater than said wayside imposed speed limit, wherein the improvement comprises:

speed profile generating means responsive to said signal receiving means receiving a second speed limit at a time when a first, higher, speed limit had been effective to generate a speed limit profile, monotonically decreasing from said first toward said second speed limit, and means in said governor means to withold application of said braking force or requirement so long as said speed limit profile is generated and said vehicle speed is less than a current value of said speed limit profile.

Therefore, in accordance with one aspect of the invention, apparatus is provided to generate and employ a transitional speed limit signal, which is initiated on detection of a reduction in vehicle speed limit. This apparatus performs the governor operation by accepting both the wayside generated new speed limit, and the transitional (or profile) speed limit, and comparing the higher of the two to the actual vehicle velocity to impose restrictions on the vehicle only in the event that the higher of the two speed limits is violated.

Although it should be apparent that the profile speed limit can be time or distance based, an embodiment of the invention hereinafter described is distance based.

The transitional speed limit generating apparatus includes a transitional speed limit generator as well as a transitional speed limit validator. The transitional speed limit generator responds to the newly imposed speed limit, but only after that newly imposed speed limit has been validated, in a vital fashion, to ensure that spurious effects do not induce operation of the transitional speed limit generator. The transitional speed limit generator, in dependence on the "old" speed limit then selects a series of distance regions or segments and associated with each of these segments is a different speed reduction rate (mph/foot). Periodically, tachometer readings, indicative of vehicle travel, are passed to the transitional speed limit generator, and the transitional speed limit generator operates cyclically to determine the distance travelled by the vehicle since the last cycle of operation, and from that parameter determines, based on the appropriate rate factor, a velocity reduction; and finally, the old transitional speed limit is reduced by the newly determined velocity reduction to generate a new transitional speed limit. This resulting new transitional speed limit is passed back to the transitional speed limit validator, wherein it is validated by techniques to be explained. The governor employs the transitional speed limit, as the effective speed limit on which to base restrictive action on board the vehicle, in the event that the vehicle velocity exceeds the transitional speed limit.

Aspects of the invention relate, not only to the functions performed but also the manner in which these functions are implemented to simultaneously respect the significant constraints of safety, speed of operation, reliability, cost, maintainability and space requirements. In a preferred embodiment the invention is implemented in a digital processor, more particularly a microprocessor.

To ensure vital generation of this transitional speed limit sequence, techniques of diversity and cycle checking are employed; diversity referring to the use of more than one piece of equipment to perform the same function, and not to accept the result of that function until the diverse results validate the operation of that function. Cycle checking represents the additional requirement for each of the components in the apparatus to show a predetermined pattern of changing relationships precluding a fail on or fail off to allow the process to proceed.

The diversity checking begins at the initiation, wherein the "old" wayside imposed speed limit is transmitted via two different channels, in two different forms to the transitional speed generator. In the transitional speed generator, the two different wayside imposed speed limit representations are used to address associated tables, and the entries extracted therefrom relate to the length of the first segment. While these parameters may be widely different, each in its own channel represents the same segment length, in the physical world, or otherwise the process does not produce results which will be validated.

To provide diversity protection two parallel processes proceed, operating on identical data which is encoded differently so signals from one process are unusable in the other. The results of these processes are checked to validate the result. For convenience in description we refer to a pair of processors, however it should be understood that the two processors need not be implemented in distinct devices, they can be a single, time shared microprocessor or other logic device.

In accordance with the invention, a pair of processors are provided on-board the vehicle as part of the speed profile generating apparatus. The processors are provided with information respecting the old and new speed limits, as well as the speed reduction rates, the duration of the independent parameter over which the various reduction rates are effective, and changes in the independent parameter. Diversity checking on changes in the independent parameter is also provided in the form of two tachometers or at least one tachometer channel for each processor. Although the two processors operate on information which is essentially identical, the manner in which this information is coded is different so that the two different processors are operating on information which at least appears to be different. Periodically the results produced by the processors are checked (an example of diversity since two different processors are operating on essentially the same information). The speed profile generating process is allowed to continue only so long as the results produced by the two processors bears a specified relation. However, the specified relation which the output of the two processors must maintain in order to allow the process to continue is not unchanging, rather this relation must cycle between a first and second relation (an example of cycle checking). Therefore, in accordance with another aspect, the invention provides a transitional speed limit generator responsive to a pre-existing speed limit and to signals indicative of vehicle travel for generating a series of transitional speed limits comprising:

first tachometer channel means for producing signals indicative of vehicle travel, first processor means for generating a first time series of transitional speed limits in response to said first tachometer channel means, second tachometer channel means for producing signals indicative of vehicle travel, second processor means for generating a second time series of transitional speed limits in response to said second tachometer channel means, comparison means for comparing each transitional speed limit of said first series with a corresponding transitional speed limit from said second series to validate said transitional speed limit of said first series, but only if a relationship between sequential pairs of speed limits from said first and second series cycles between a first and second relation.

Other objects, features, advantages and characteristics of the invention will become apparent as this description proceeds.

BRIEF DESCRIPTION OF THE DRAWINGS

The invention will now be further described so as to enable those skilled in the art to practice the same in the following portions of the specification when taken in conjunction with the attached drawings in which like reference characters identify identical apparatus and in which.

DETAILED DESCRIPTION OF PREFERRED EMBODIMENTS

Figure 1:
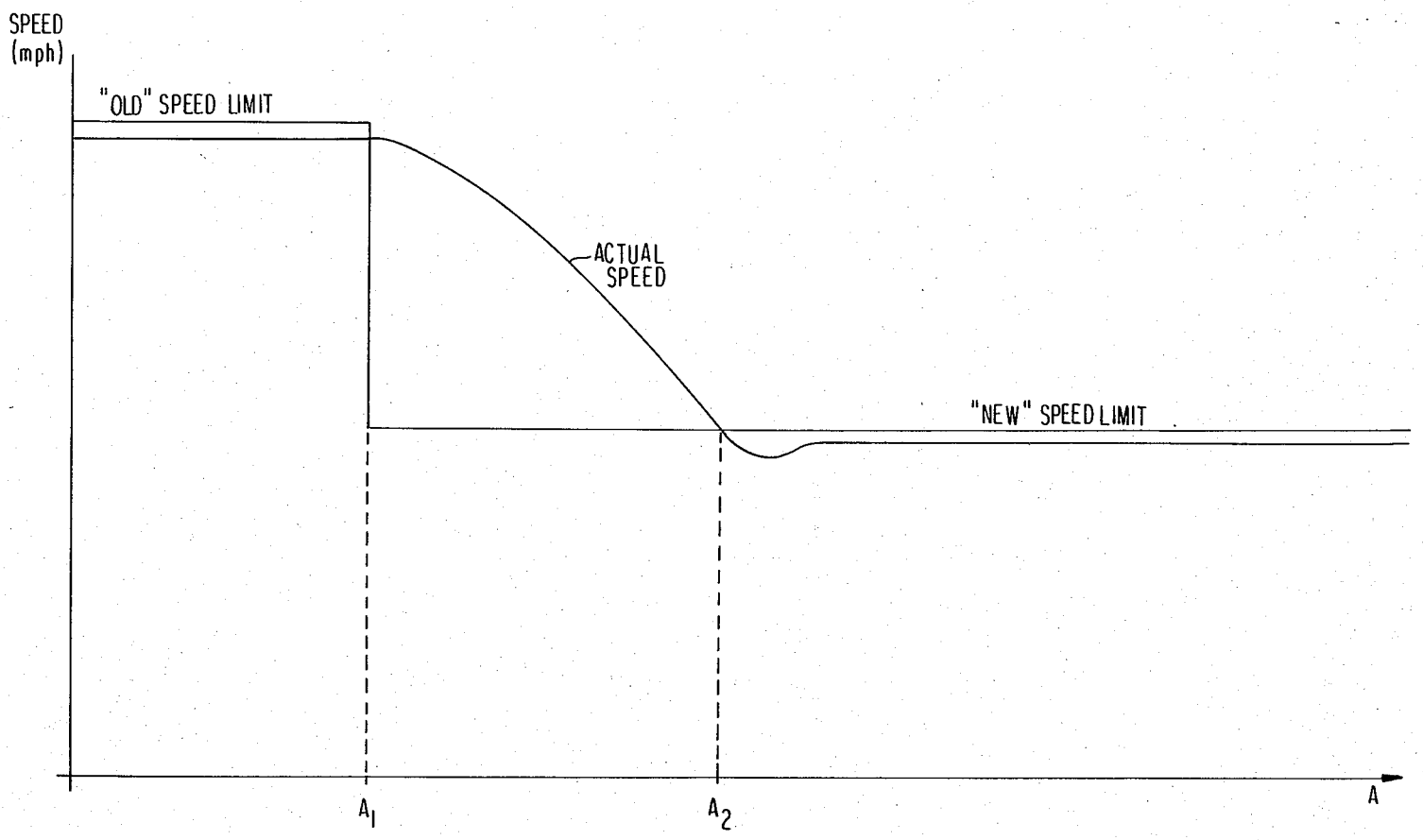
FIG. 1 PRIOR ART
FIGS. 1–3 plot wayside imposed speed limit versus independent parameters such as time or distance along with actual vehicle speed to illustrate operation of prior art equipment (FIG. 1) and operation of the inventive apparatus wherein the independent parameter is time (FIG. 2) or distance (FIG. 3)
Figure 2:
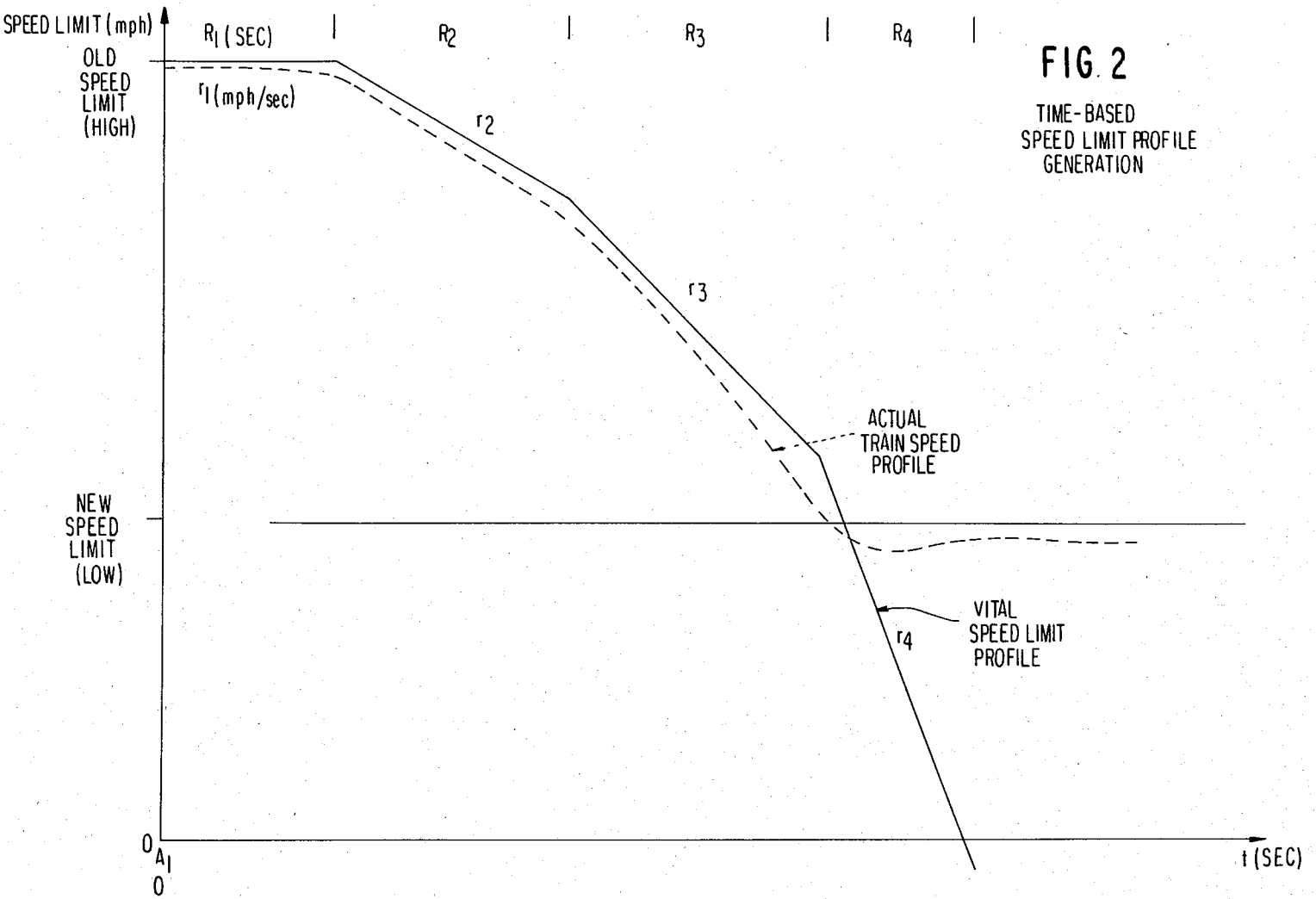
Figure 3:
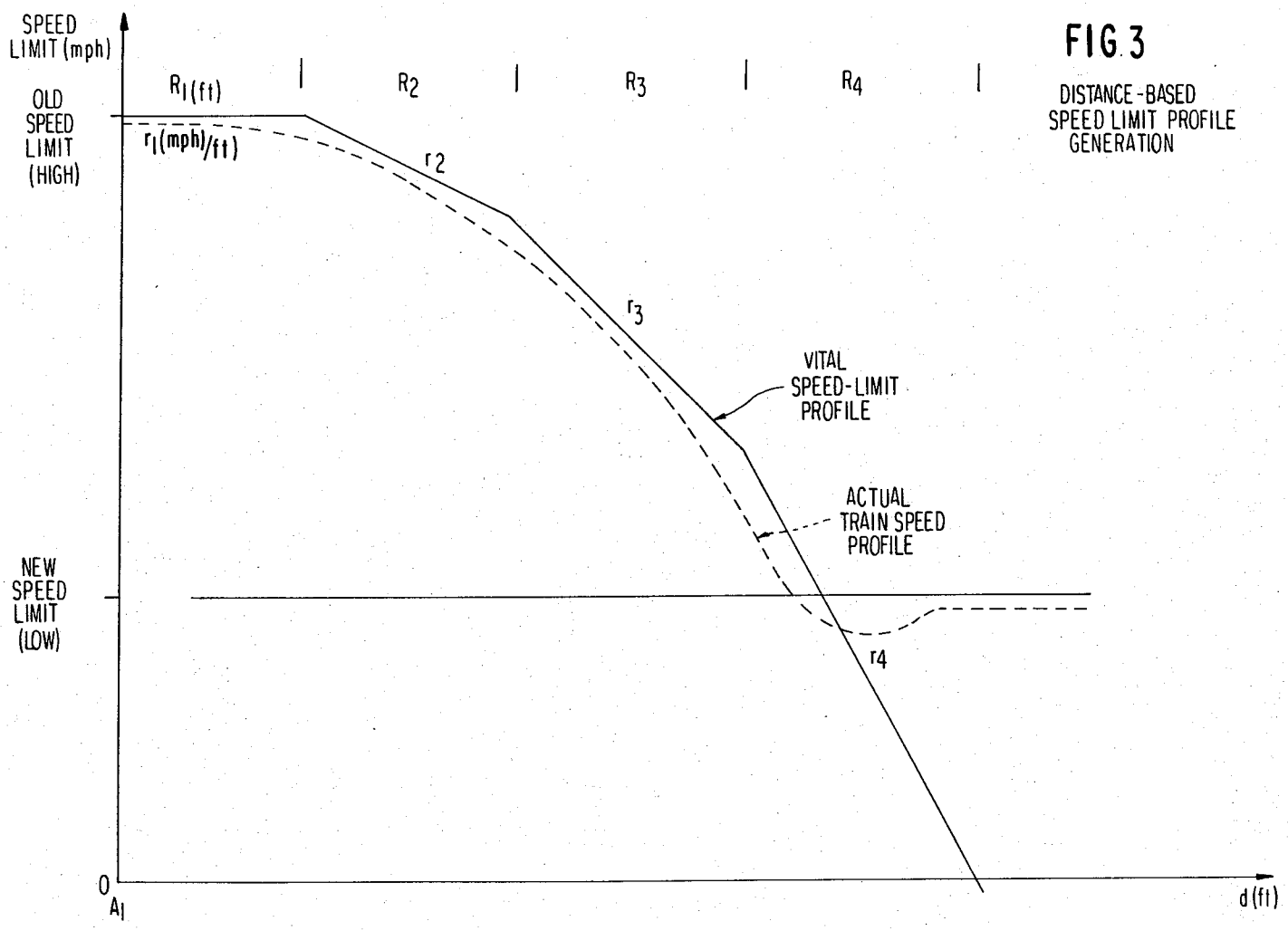
Figures 4A, 4B:
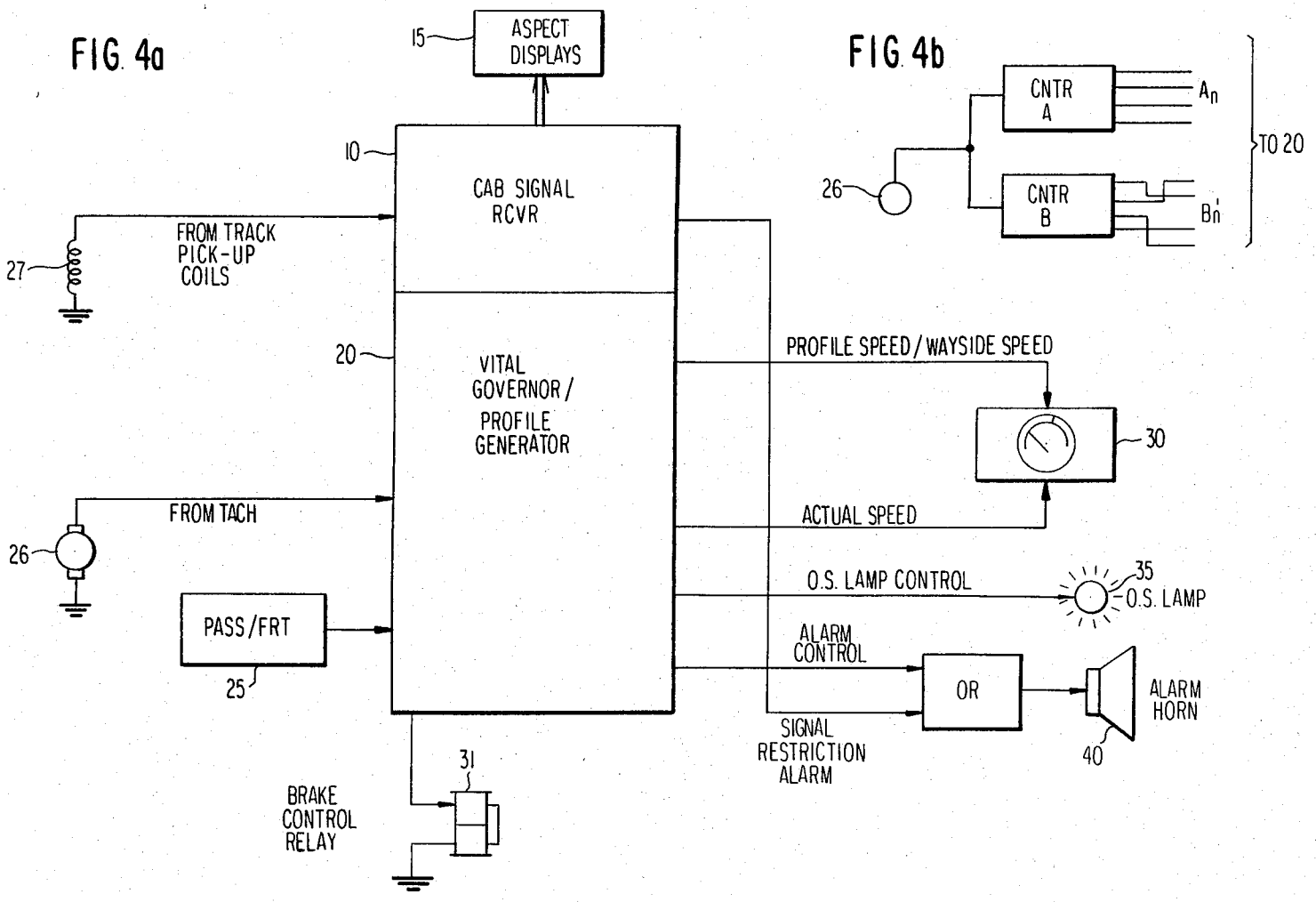
FIGS. 4*a* and 4*b* are block diagrams of vehicle carried apparatus in accordance with the invention.

FIG. 4*a* is a block diagram of a preferred embodiment of the invention. As shown in FIG. 4*a*, a conventional cab signal receiver 10 responds to wayside generated signals received via a track pick-up coil shown at 27. The cab signal receiver 10 includes the apparatus for decoding signals received from the wayside which are used in a number of respects. Firstly, conventional aspect display 15 provides an indication to a vehicle operator of the wayside generated signals. Similarly, under certain circumstances the cab signal receiver 10 may provide a signal (identified as a signal restriction alarm) to audibly warn a vehicle operator of a transition to a more restrictive condition. The cab signal receiver 10 in addition provides indications of the wayside generated signals to a vital governor/profile generator 20. The vital governor/profile generator 20 receives additional inputs; as shown in FIG. 4*a*, a significant input is provided from a tachometer 26. The rate at which pulses are received from the tachometer 26 may, as is well known to those skilled in the art, indicate vehicle velocity. Furthermore, signals may be received, for example from the passenger/freight register 25, to personalize the vital governor/profile generator; on the other hand, vital governor/profile generator 20 may be personalized internally for passenger and/or freight or other classes of operation.

Based on its input signals, the vital governor/profile generator provides a number of outputs. Firstly, it provides an indication to a conventional dual segment indicator 30 indicative of actual vehicle speed. It may also provide a signal to light an overspeed lamp 35 to indicate to the vehicle operator that the vehicle is over speed. It may also, simultaneously, or under other circumstances provide the alarm control signal to an alarm horn 40. The overspeed lamp 35 and alarm 40 are not essential to the invention, but they provide useful indications to a vehicle operator (if an operator is contemplated). A further output may be provided to a brake control relay 31 which, if actuated, imposes braking forces on the vehicle in a manner known to those skilled in the art. A final output, also provided to the dual segment display 30 is an indication of either profile speed, if a profile is being generated and/or a wayside imposed speed limit, if no profile is being generated. Thus, the operator (if one is present) is informed by the dual segment display 30 of both actual vehicle speed and the effective one of the profile speed (if present) and wayside imposed speed limits.

Alternatively the invention can also be applied by splitting the functions of the governor and profile generator. In this alternative application, the governor is essentially a prior art governor which compares wayside imposed speed limits to actual vehicle speed. The profile generator generates the profile speed limit under appropriate circumstances and, may also include for example a comparison function to compare actual vehicle speed with profile speed in the event that a profile is being generated. The result of this comparison controls an inhibit signal which is also provided to the governor to inhibit brake application even though actual speed exceeds wayside imposed speed limit in the event that actual speed is less than the effective profile speed limit.

The functions performed by the vital governor/-profile generator include:

1. Comparison of wayside speed limit with actual vehicle speed in the absence of speed limit profile generation;

2. Detection of a transition from a first higher speed to a second lower speed wayside imposed limit to initiate generation of the profile speed limit;

3. Generation of speed limit profile as a function of input parameters and validation thereof;

4. Comparison of effective profile speed limit with actual vehicle speed;

5. Witholding break application in the event that the actual vehicle speed is less than the effective profile speed limit even though it is greater than the wayside imposed speed limit.

Regardless of whether or not the governor function is integrated with the profile generation process, the governor function of comparing the actual vehicle speed with the wayside imposed limit is entirely conventional and will not be further described. Reference however is made to Sibley U.S. Pat. No. 4,181,849 which discloses a vital relay driver having controlled response time, which can be programmed to perform the governor function.

Vehicle motion may be controlled automatically, i.e. an overspeed condition leads directly to a brake application. On the other hand, in the presence of an operator, an overspeed condition may merely produce an operator alert indicating a requirement for operator initiated braking which, if not applied, is followed by automatic brake application. Either of these procedures (and others) can be improved by use of the invention. The invention inhibits automatic brake application or the operator alert in the event actual speed is below the current profile speed.

Before describing in further detail the governor/-profile generator of the present invention, a word is in order about assuring safe operation. The critical functions effected by the apparatus of the present invention are:

1. Sense a speed limit reduction in a manner that assures that the transition is from a valid established higher speed limit;

2. Ensure that when the profile generation process is initiated it correctly receives input data corresponding to the first or higher speed limit and the second or lower speed limit;

3. Ensure that the profile, once generation thereof has begun, is never restarted, that is the profile must monotonically decrease towards zero or if the process is terminated, be reset to zero or other terminating speed limit such as the current wayside speed limit;

4. Ensure that the various segments of the profile decrement at the appropriate rate;

5. Ensure that the profile speed limits used by the governor (comparing actual speed limit to profile speed limit) are the correct values generated by the profile generator;

6. Ensure that the governor operates on current data (that is ensure that old data is not employed);

7. Assure proper detection of termination of the profile.

In respect of (1) establishing valid speed limits from which a transition can be effected via a speed limit profile the apparatus must guard against contact bounce or other transient effects giving a false indication of a non-existent high speed limit. Such effects could lead to generation of a profile beginning at an unsafely high speed limit. The apparatus guards against this occurrence by accepting as a valid speed limit (that is a speed from which a transition can be started) only those speed limits which are available unchanged over a fixed period of time or distance of travel.

Once the transition from a validly established high speed limit to a lower speed limit is detected, profile generation begins.

The initiation (2) of profile generation must also be protected. As will be seen later, initiation of the speed profile generation process requires accessing a table at which certain values are stored; the access is made based on the "old" speed limit. This speed limit, however, is passed to the profile generation process as a representation of the speed limit and a related value such as its complement. The values passed are the appropriate addresses to begin the table reading process. Continuation of the profile generation process requires that these values maintain a specified relation to each other as they are updated. However, the values extracted from the table do not have this relationship. Rather, one of the first steps in the program is to operate on the values extracted from the table to provide that relationship. The very operation also destroys the table access entries passed on initiation, ensuring that the profile generation process can not be re-initiated erroneously.

In order to (3) prevent profile regeneration, two techniques are employed. As described above, in the course of the initiation process the table accesses based on the "old" speed limit are destroyed. Accordingly, regenerating the profile at some later time based on the initial access is not possible. Of course there is the potential for reinitiating the profile generation process based on the "new" speed limit. However, that event is not unsafe since any profile generated starting at the "new" speed limit would impose a speed limit less than the wayside imposed "new" speed limit.

The other technique used to ensure that profile regeneration does not occur is based on the manner in which parameters identifying the extent of each segment and the associated rate parameter are extracted. A new segment cannot be extracted until the prior segment has been processed to completion. Once information respecting a new segment is loaded, the addresses to access the old segment are destroyed.

During the course of generating the speed limit profile, some assurance is needed that the speed profile generated decreases (4) at the appropriate rate. This is assured by diversity; providing either two different processors or two different processes in the same processor operating on information extracted from two different tables, and by continually comparing the results of these processes to ensure that the appropriate relation (offset) is maintained.

To ensure that the data passed from the profile generator to the governor is safe (5) the data passed back to the governor is one or more pairs of words which must maintain the expected relationship.

To protect the governor (6) against old data, first the memory locations containing the "old" data are overwritten. The overwritten data are such that they do not have the appropriate relationship to be accepted as valid speed limit parameter data, however they do have a specific relationship which is checked.

Finally, to detect the end (7) of the profile, predetermined signals are written in an output table at the start of each cycle when a profile is not being generated.

The vital governor/profile generator 20 is driven on an interrupt basis and the time between interrupts as selected to be slightly longer than the normal running time of the program. While the program has a plurality of modules, only those modules pertinent to the invention will be described.

Figure 5A:
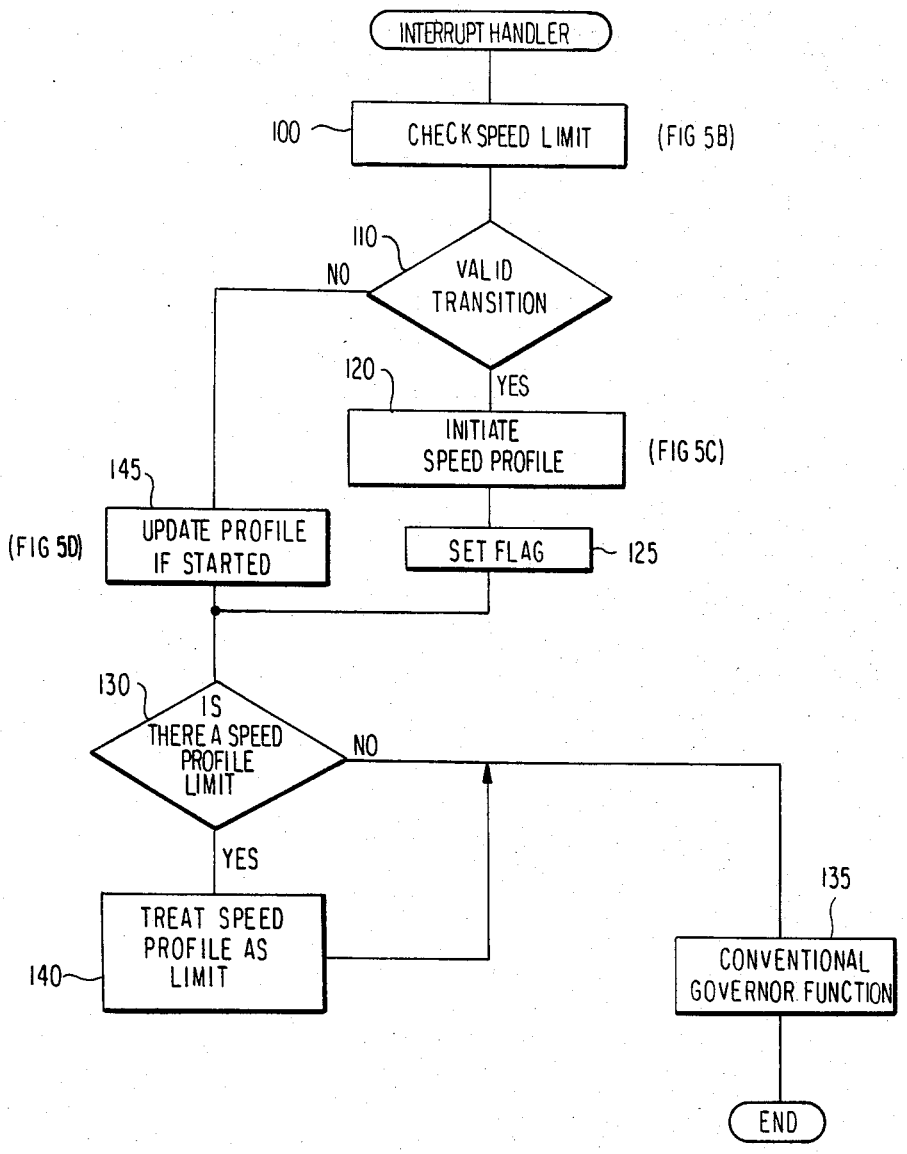
FIGS. 5*a*–5*d* and 5*f* are flow diagrams illustrating the processing in the profile generator and validator.
Figure 5B:
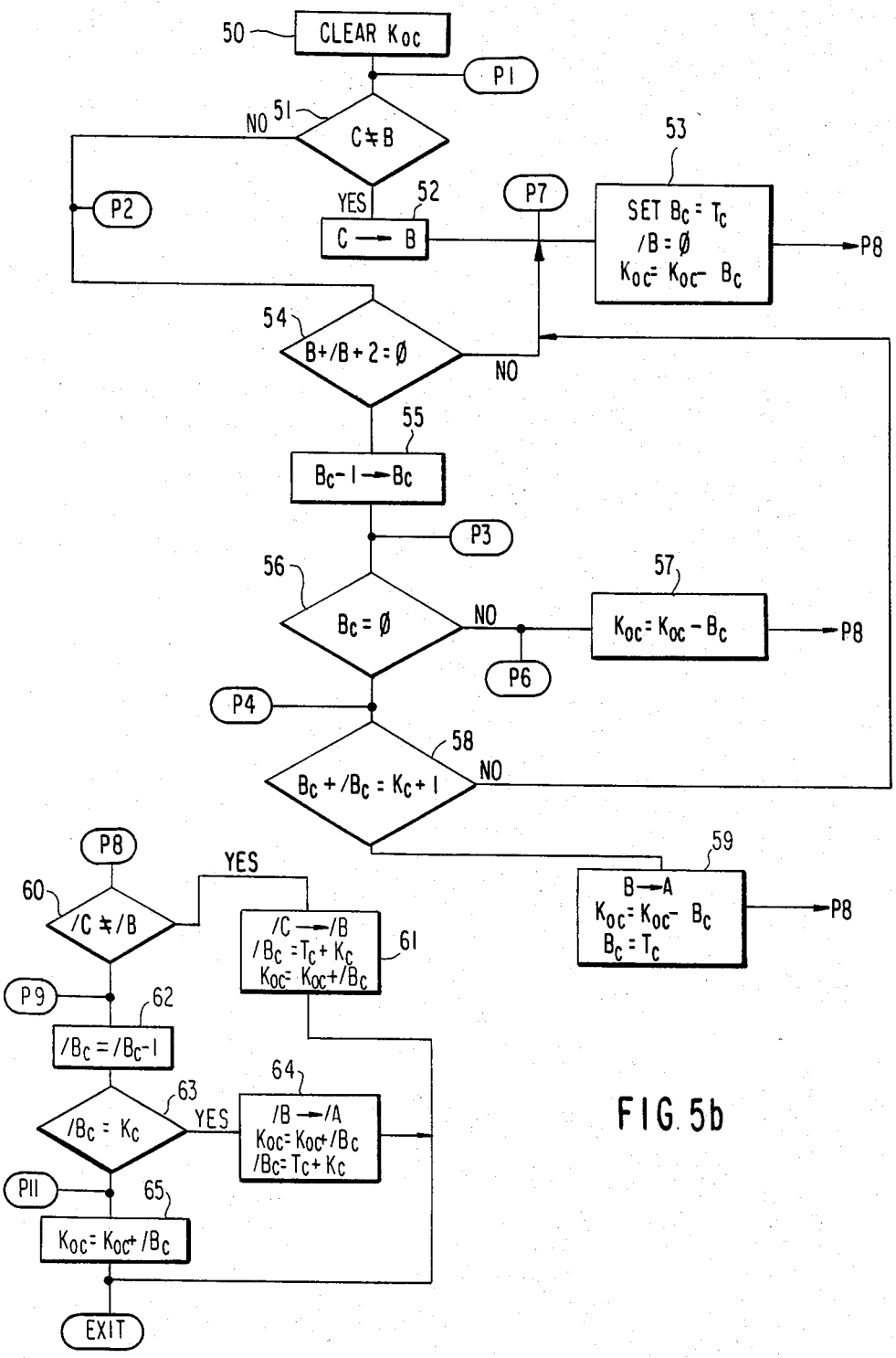

FIG. 5*a* illustrates an overall block diagram of the interrupt handling routine. As shown in FIG. 5*a*, when an interrupt is detected, step 100 checks the current speed limit; this is provided by the cab signal receiver 10. While FIG. 5*b* shows this processing in more detail, at this point it is sufficient to note that as explained above, a check is made to determine if a valid transition in speed limits has occurred. A valid transition is a transition from a validly established speed limit (received unchanged for some fixed period of time or distance) to a lower speed limit. Step 110 checks to see if such a valid transition has occurred based on the processing effected in step 100. If a valid transition is detected, step 120 initiates a speed profile generation; the processing for this is shown in more detail in FIG. 5*c*. At this point, it is sufficient to note that step 120 is the interface between the governor and the profile generation, and using data passed from the governor, step 120 initializes the speed profile generation process by reading selected entries in tables and setting up certain registers and pointers. Step 125 sets a flag to indicate that a speed profile has begun. Thereafter, step 130 checks to see if there is a speed profile limit. If there is no such limit, step 135 performs the conventional governor function of comparing the wayside imposed speed limit with the actual speed of the vehicle and taking appropriate action based on that processing. On the other hand, if there is a speed profile then step 140 ensures that the effective speed profile is treated as the wayside imposed speed limit which will be used in the comparison of step 135.

Accordingly, step 140 assures that brake application or alert is witheld, notwithstanding the relation between actual speed and wayside imposed speed limit if the actual speed is less than the speed profile limit.

In the event the governor function is physically separate from the speed profile generator, step 140 compares profile speed limit (if any) to actual speed. If the vehicle is underspeed the result is production of an inhibit signal to inhibit brake application or operator alert which could result from the conventional governor. Of course, if there is no profile or if the vehicle speed exceeds the profile limit, the inhibit signal is not produced.

In the event that step 110 does not detect a valid transition (such as to initiate generation of a speed limit profile) then step 145 up-dates the profile if one had been started previously. If no profile is being generated, step 145 is effectively a non-operation.

The appropriate ones of steps 100 to 145 are run on an interrupt basis so that as time passes and during generation of a speed limit profile, this actual effective speed limit or the current speed limit of the profile changes to smoothly bring the vehicle from its former old or higher speed limit to its new or lower speed limit.

FIG. 5*b* illustrates the processing taking place in step 100 of FIG. 5*a* to check a potential speed limit transition. Before describing the logic shown in FIG. 5*b*, the nomenclature employed is explained. "A" corresponds to the last speed limit which has been received unchanged for a fixed period of time or distance, that fixed period of time in this embodiment is measured as a certain number ($T_c$) of machine cycles. "B" is a speed limit which has been received unchanged for more than one cycle and "C" represents a currently received speed limit. $B_c$ represents the difference between the number $T_c$ and the number of cycles over which the speed limit represented by B has been received, unchanged. Thus, $B_c$ can be considered a timer directly indicating the remaining time which must expire before speed limit B is considered validly received. /A, /B and /C respectively represent coded representations for A, B and C corresponding to the other process (diversity). $/B_c$ represents the sum of $B_c$ with a constant ($K_c$) and finally, $K_{oc}$ is a calculated value which serves as a check that the logic of FIGS. 5*b* has been correctly executed. The reference characters prefixed with P are merely used to locate points in the processing. Thus step 60 is performed after steps 53, 57 and 59 as referenced by P8.

Referring now to FIG. 5*b*, step 50 clears $K_{oc}$ (that is the location at which the parameter is stored). Step 51 compares C to B; if equal it of course means that the currently received speed limit is the same as a previously received speed limit; in order to maintain the parameters correctly, certain changes must be made. Accordingly, step 54 compares the sum of B+/B+2 with zero. If equal, it means that another machine cycle has occurred in which the speed limit represented at B (and at C) has been unchanged. Therefore, it is appropriate to decrement $B_c$ which initially began at the number of cycles over which a speed limit has to be received before it can be considered valid. Once $B_c$ is decremented via step 55, step 56 checks to see if $B_c$ is zero. If it is, then we may be able to up-date the A speed limit. To determine whether or not that can be up-dated, step 58 compares the sum of $B_c$ with $/B_c$ to $K_c+1$. If they are equal, the up-dating can be effected and therefore step 59 transfers B to A, sets $K_{oc}$ to equal a new value as its previous values less $B_c$ and at the same time $B_c$ is reset for a new check by setting it equal to the constant $T_c$.

Following step 59, step 60 compares /C to 1B. If unequal step 62 decrements $/B_c$ and step 63 is performed to compare $/B_c$ with $K_c$. If equal step 64 is performed which replaces previous value of /A with the present value of /B, up-dates $K_{oc}$ and $/B_c$. On the other hand, if step 63 determines that there is an inequality, then only $K_{oc}$ is up-dated. In either event, step 64 or 65 terminates the processing with a speed limit transition check.

In the event that at step 51 it is determined that C does not equal B, then step 52 is performed to transfer the quantity C to B (to assure their future equality). Thereafter, step 53 is performed which resets $B_c$, sets /B to zero and resets $K_{oc}$. Thereafter, the program skips to step 60.

The processing just described is effected on an interrupt following detection of a new speed limit (indicated by the fact that C was not equal to B). On this cycle, B is made equal to C (step 52) so that in succeeding cycles step 54 is performed rather than step 52.

On such succeeding cycles and before the comparison performed by step 54 is satisfied, step 53 is performed rather than step 55. Step 53 has already been explained and is used to reseed the $B_c$ counter and correspondingly /B.

In the event that the comparison of step 54 is satisfied, the comparison effected by step 56 ($B_c$ in zero) may not be satisfied. In that event, step 57 is performed rather than step 58, to reseed only $K_{oc}$. In a similar fashion if the equality tested for by step 58 is not satisfied, then step 53 is performed rather than step 59. As shown in FIG. 5*b*, however, step 60 is performed following the performance of steps 53, 57 or 59.

In the event that the inequality tested for by step 60 is satisfied then step 61 is performed rather than step 62 et seq. Step 62 transfers /C to /B, and reseeds the $/B_c$ counter as well as $K_{oc}$.

In view of the foregoing it should be apparent that the processing of FIG. 5*b* processes the same information in two "channels" or processes, steps 51–59 process (in the main) the true channel whereas steps 60–65 process the complement channel or process. Each channel maintains A, B and C quantities indicative of a last valid speed limit from which a transition can be initiated, the last speed limit received for more than one cycle and the currently received speed limit, respectively. The intermediate quantity becomes the initial quantity (that is B is transferred to A) if both the $B_c$ counter is decremented to zero (from $T_c$, one count being decremented for each cycle) and the relationship between true and complement channels required by step 58 is satisfied.

In the complement channel similar processing is effected.

Figure 5E:
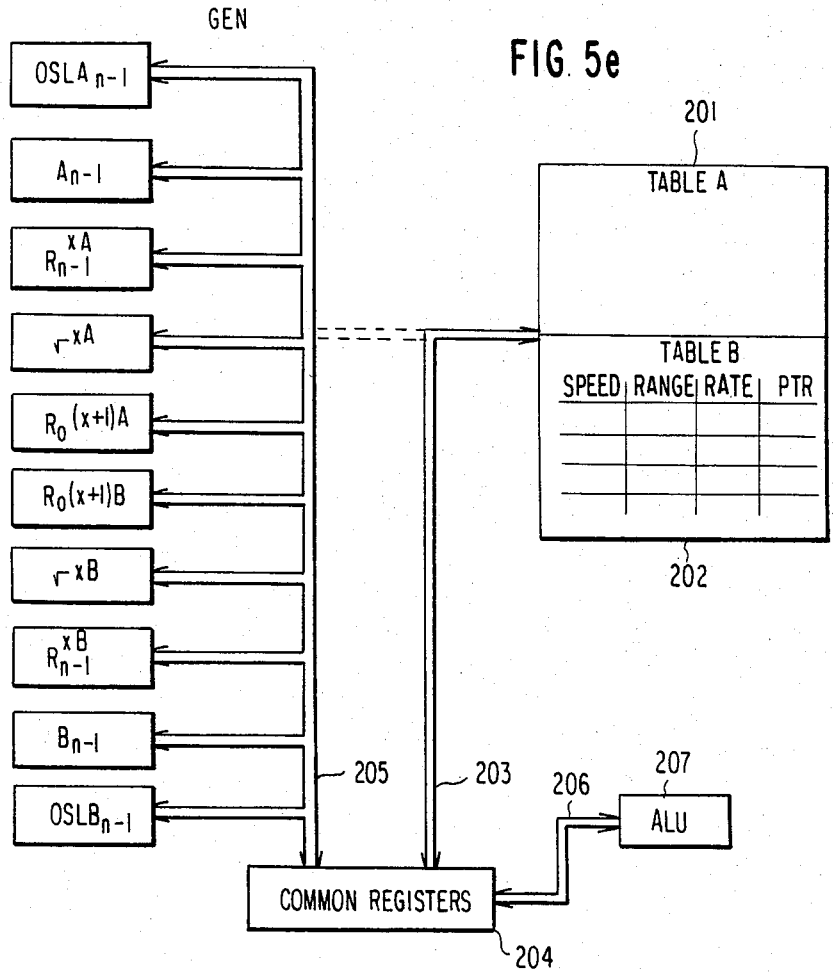
FIG. 5*e* is a functional block diagram of the processors.

Before discussing the logic used to initiate the speed profile (step 120) or up-date a speed profile (step 145) reference is made to FIG. 5*e* which illustrates a functional block diagram of the processor 20.

As mentioned above, the invention is implemented in either two different processors, or, as in a preferred embodiment of the invention, two processes in the same processor, essentially processing the same information to achieve essentially the same result. The information operated on is, however, coded differently in the two different processes and the results only validated if the difference between the results is the expected difference.

As described above, each profile as generated is broken up into a number of segments, accordingly a distance based profile generator provides a number of different distance segments in each profile. Each segment has a length (in a time based system of course each segment would have a duration rather than the length) and an associated rate, for example miles per hour per foot (in a time based system the rate is expressed in miles per hour per second). In order to link the segments in a profile, each segment also includes a pointer to the data defining the length and rate for the next segment of the profile. In processing a segment, a speed limit quantity is decremented based on the present rate and change of distance, the segment travelled through is decremented (based on distance travelled). Each of these parameters is stored in a register, and there are two sets of these regsiters since there are two sets of processes in operation. Thus, FIG. 5*e* represents the information transfer taking place. Those skilled in the art will be aware that the registers shown in FIG. 5*e* may either be dedicated or software registers. Reference now to FIG. 5*e* shows a pair of tables, Table A 201 and Table B 202, each with the same format but different data. As shown in FIG. 5*e*, Table 202 includes a plurality of entries, one for each different speed from which a transition can be encountered, each entry includes three items, a segment length representation, a rate representation and a pointer; the segment length and rate representations should be apparent, the pointer points to the next segment for the particular profile. An information transfer path 203 couples the tables to a set of common registers 204. The set of common registers is also coupled via other information transfer paths 205 and 206 to an arithmetic logic unit 207 and two sets of registers, with five registers per set. Each process has a dedicated set of registers. For reference we can refer to the A or B process. Each set of registers includes a speed limit register ($OSLZ_{n-1}$, where Z is either A or B), a tachometer counter register ($Z_{n-1}$, where Z is A or B) a remaining segment length register ($R_{n-1}^{XZ}$, where Z is either A or B), a rate register ($r^{XZ}$, where Z is either A or B) and a pointer register ($R_0^{(X+1)Z}$, where Z is either A or B). In describing the processing in detail, a number of parameters are used, and these are defined below:

$n$=The current machine cycle number.

$A_n$=Channel A tachometer counter reading.

$\Delta A_n = A_n - A_{n-1}$=The accumulated tachometer counts difference between the n−1 cycle reading and the n cycle reading of Channel A.

$OSLA_\emptyset$=The speed limit value from channel A passed to initiate the profile.

$OSLA_n$ = The value of the profile speed limit parameter for channel A passed to the governor on cycle n.

$B_n'$ = Channel B tachometer counter latched value. $B_n'$ differs from the actual channel B tachometer counter reading in that $B_n'$ has been coded before being latched.

$B_n$ = Channel B tachometer counter reading. $B_n$ is found by operating on $B_n'$ with function $f_b$. This operation converts the latched reading to the counter reading. ($B_n = f_b(B_n')$).

$\Delta B_n = B_n - B_{n-1}$ = The accumulated tachometer count difference from cycle n−1 to cycle n on Channel B.

$OSLB_\emptyset$ = The speed limit value from channel B passed to initiate the profile.

$OSLB_n$ = The value of the profile speed limit parameter (associated with channel B) passed to the governor on cycle n.

$R_n^{xA}$ = The instantaneous profile segment length, i.e., the distance left to travel in profile segment x, channel A, at the current (nth) cycle.

$r^{xA}$ = The rate (in mph/ft.) at which OLSA is decremented; the value of $r^{xA}$ is determined by the x in $R_n^{xA}$. In other words, the current segment determines the current rate at which OSLA is decremented. Once $R_n^{XA}$ is decremented to zero, the value of x changes, and a new rate is applied.

$R_n^{xB}$ = Segment length parameter associated with channel B.

$r^{xB}$ = The rate (in mph/ft) at which OSLB is decremented.

$K_A$ = A constant value put in place of OSLA when no profile is being generated.

$K_B$ = A constant value put in place of OSLB when no profile is being generated.

INT[ ] ≡ The "integer portion" of the parameter in brackets. Always rounded to the lowest integer value, i.e., INT[5.78] = 5.

FRAC[ ] ≡ The "fractional portion" of the parameter in brackets, i.e., FRAC[X] = X − INT[X].

In view of the foregoing now reference is made to FIG. 5*c* which illustrates in more detail, the steps performed in initiating the speed profile. As shown, step 70 reads the speed limit and stores it. The speed limit read is provided initially by the cab signal receiver 10; however, this parameter ($OSLA_\emptyset$) is operated on so as to produce $OSLB_\emptyset$ in such a fashion that $OSLB_\emptyset$ equals $f_{bl}$ ($OSLA_\emptyset$, Y). A suitable relationship is:

$$OSLB_\emptyset = OSLA_\emptyset + \sigma^y,$$

where $\sigma^y$ is a positive integer, unique for each different value of y, and wherein y relates to a wheelwear parameter for example. The exemplary relationship provides for an offset between the A and B channel speed limits, for example if the actual speed limit is to be 40 mph, it might be represented in channel A as 100 and in channel B as 150, both representations corresponding to the identical speed limit of 40 mph, the offset being of course 50. The relationship also indicates that this offset may be a related to wheel wear.

Accordingly, step 70 effects transfer of the appropriate speed limit values for both the A and B channels to the appropriate register ($OSLZ_{n-1}$, where Z equals A or B).

Thereafter, step 71 accesses the tables (201 and 202) to extract segment length, rate and pointer and store these parameters in the appropriate registers shown in FIG. 5*e*.

Thereafter, step 72 reads the tachometer. At this point it should be noted that the tachometer may be a two-channel tachometer in which the count of both channels advances at a common rate but one channel is scrambled or rotated with respect to the other channel. Furthermore, there may well be an offset between the unscrambled count with respect to the count in the other channel. Therefore, step 72, in reading the tachometers, reads both channels, stores the count from the unscrambled channel in the associated register ($A_{n-1}$, for example) operates on the scrambled tachometer count and stores the result in $B_{n-1}$ (unscrambled).

Step 70, in storing $OSLA_{n-1}$, leaves a copy in one of the common registers 204. This copy is used to access Table A and the associated entry is retrieved. The segment length parameter, rate parameter and pointer parameter are transferred to their respective registers. Since a common register 204 is used to access the table, once the register is rewritten, reaccessing the table at the original location is no longer possible.

Accordingly, at the completion of step 72 the A set of registers has been initialized, although similar processing for the B set of registers has not been discussed, similar processing is effected by steps 70–72.

FIG. 4*b* is a functional block diagram illustrating the two channel tachometer. More particularly, tachometer 26, which may be a toothed wheel or the equivalent device produces a series of pulses, the rate at which these pulses are produced indicates vehicle velocity, and of course the number of pulses produced indicates distance travelled. The output of the tachometer 26 is provided as a clocking input to counter A and counter B. The outputs of these counters $A_n$ and $B_n'$ provide the inputs to the processor 20. Although FIG. 4*b* shows each counter having four outputs or four stages, those skilled in the art should be aware that this only exemplary, and typically more than four stages in each counter is provided. However, FIG. 4*b* indicates that the output of counter B is "scrambled" whereas the output of counter A is not. It should also be apparent that the "scrambling" illustrated in FIG. 4*b* is also exemplary, and other types of "scrambling" or bit rotation could be used. What is preferable is that some decoding of the output of counter B is necessary in order for the receiver device (processor 20) to faithfully track the changing state of counter B. By reason of the "scrambling", the processor is prevented from using an output of one channel in another. This provides a check on the diversity operation since the processing comes to a halt if one channel is not operating properly. It should also be apparent to those skilled in the art that while FIG. 4*b* shows the discrete counters and the "scrambling" or encoding produced by changing the relation between physical leads, other equivalent techniques could be employed to produce the same result. For example, rather than employing two discrete counters, the counting as well as the scrambling could be implemented in software in the processor 20.

Returning now to FIG. 5*a*, on an interrupt following initialization via step 120, and assuming valid transition is detected at step 110, then step 145 first recognizes that a profile has been started (by checking the flag set at step 125, for example) and therefore an update operation is performed.

A flow diagram for the up-date operation is shown in FIG. 5*d*.

Steps 73–75 are concerned with the tachometer. Step 73 reads the tachometer count ($A_n$, for example). This quantity is stored in one of the working registers 204. Thereafter step 74 determines the difference between present tachometer count and the previous cycle's tachometer count by reference to the register $A_{n-1}$. This quantity $\Delta A_n$ is also stored in one of the common registers 204. Step 75 then up-dates the tachometer count, that is it transfers $A_n$ to the register $A_{n-1}$.

Step 76 thereafter decrements the segment length parameter and saves the decremented parameter in the $R_{n-1}^{XA}$ register. The generic relationship for decrementing the segment length parameter is shown below:

$$R_n^{XA}=R_{n-1}^{XA}-F_{a4}(A_n, (-1)^n).$$

In a particular example, the following relationship can be used:

$$R_n^{XA}=\left[R_0^{XA}-\left(\sum_{m=1}^{n} A_m\right)\right]$$

where $R_0^{XA}$ is the segment length extracted from table A.

Step 77 performs a test on the up-dated or decremented segment parameter to determine whether or not it has passed below a limiting value. In the channel A process the limiting value is 0, below we discuss the channel B processing and the fact that it uses a limit different from zero. In any event, for the channel A operation, step 77 tests $R_n^{XA}$ to see if it has passed through zero. If it has, steps 82–89 are performed; these are discussed below. Assuming the up-dated segment length has not passed through zero, then steps 78–80 are performed. Steps 78–79 up-dates the profile speed limit. First step 78 obtains the product of $\Delta A_n$ with the rate. One relation that could be used is shown below:

$$OSLA_n=OSLA_{n-1}-F_{a3}(\Delta A_n{*}r^{XA}, (-1)^n).$$

In implementing this relationship, fractional changes in speed limit parameter may be saved from one cycle to the next as shown in the following three relationships:

$$OSLA_n=OSLA_{n-1}-INT[(\Delta A_n{*}r^{XA})+\Delta E_{n-1}^{A}],$$

where $$\Delta E_n^{A}=FRAC[(\Delta A_n{*}r^{XA})+\Delta E_{n-1}^{A}],$$

and $$\Delta E_\emptyset^{A}=\emptyset.$$

Step 79 includes replacing $OSLA_{n-1}$ with $OSLA_n$. Thereafter step 80 checks to see if the newly up-dated speed limit has gone below an appropriate limit. One limit that is used in practice is the newly imposed wayside speed limit. Another appropriate limit is a zero speed limit. On reaching or passing the limit $OSLA_n$ is replaced with a constant $K_A$. This processing is shown in steps 80 and 81.

Now that we have discussed processing a segment to update profile speed limit for the case where the segment length decrementing process does not reduce the remaining segment length below a limiting value, we will now discuss steps 82–89 to describe the processing in the event that the segment length decrementing process does result in reducing the up-dated range value below some limiting value.

Before discussing the processing in detail, it is worthwhile to note that essentially the processing determines that portion of $\Delta A_n$ which reduces the remaining segment length to the limiting value (for example zero), uses this distance travel to provide a temporarily decremented speed limit ($OSLA_n'$), accesses the table to extract a new segment length, rate and pointer, using the pointer that has previously been stored. The remaining or unused portion of $\Delta A_n$ is then used in combination with the new rate to provide a new velocity reduction parameter which is used to reduce the temporarily generated speed limit to obtain a final up-dated speed limit for this particular cycle. The remainder of the processing is essentially identical to that already discussed.

In more detail, step 82 obtains a difference between $\Delta A_n$ and $R_{n-1}^{XA}$, this identifies the portion of $\Delta A_n$ which caused the segment length to go below the limit. Step 84 is essentially similar to step 78, but rather than using the entire $\Delta A_n$ it uses only that portion of it which is equal to the remaining segment length ($\Delta R^A$) in this particular segment. Step 85 is similar to step 79 except that since there is a portion of $\Delta A_n$ which has not yet been processed (namely, $\Delta R^A$) the up-dated speed limit $OSLA_n'$ is only a temporary value.

Now step 86 accesses the table using $R_\emptyset^{(X+1)A}$, to read out and store new quantities for segment length, rate and pointer. At this point steps 87–89 up-dates the newly read range parameter by considering $\Delta R^A$ as if it were actually $\Delta A_n$, step 88 and 89 up-date the speed limit in the identical fashion.

The foregoing steps are expressed in one specific example as indicated below:

$$OSLA'_n(TEMP\ VALUE)=OSLA_{n-1}-INT[(\Delta A_n-\Delta R^A){*}r^{XA}-\Delta E_{n-1}^{A}];$$

$$OSLA_n=OSLA_n'-INT[(\Delta R^A){*}r^{(x+1)A}+\Delta E_n^{A'}];$$

$$\Delta E_n^{A'}=FRAC[(\Delta A_n-R^A){*}r^{XA}+\Delta E_{n-1}^{A}].$$

Channel B Operation

In general, channel B operation is similar to the operation already described for channel A with a number of exceptions.

The first exception relates to reading to the tachometer; as already mentioned the tachometer count input to the governor/profile generator 20, $B_n'$ has been scrambled, therefore the governor/profile generator 20 operates on its input to derive $B_n$ as $f_b(B_n')$. The referred to mathematical function fb can simply be a shift left, shift right, or a bit scrambling operation in which some bits are shifted left and others are shifted right. Thus, this can be considered a decoding process exclusively associated with channel B.

As already discussed, part of the validation process is to compare the relation between the speed limit produced in the channel A and the channel B processes. To prevent this test from being passed by the unintentional use of old data, the necessary relation between these parameters on each cycle varies. To effect this, the segment length decrementing process in one of the channels (for example channel B) is slightly different than the process is channel A. In channel B:

$$R_n^{XB}=R_{n-1}^{XB}-F_{b4}(\Delta B_n,(-1)^n).$$

In a more specific example, the relation for up-dating the channel B segment length is shown as:

$$R_n^{XB} = \left[ R_\phi^{XB} = \left( \sum_{m=1}^{n} \Delta B_m \right) \right]_B + q_1(-1)^n \text{ for } [\,]_B > \sigma.$$

Two points in this relationship; first the limit (see step 77) for channel B is different ($\sigma$) than for channel A (0). Secondly, the relation for up-dating the segment length includes a factor ($q_1$) which is added on even cycles and subtracted on odd cycles. As a result the segment length difference between the A and B channels $(R_{n-1}^{xA} - R_n^{xA}) - (R_{n-1}^{xB} - R_n^{xB})$ changes from cycle to cycle by $q_i$.

The channel B process of up-dating speed limits is similar to that taking place in channel A with an exception. Generically the relation for up-dating a channel B speed limit is shown below:

$$OSLB_n = OSLB_{n-1} - F_{b3}(\Delta B_n + r^{xB}, (-1)^n).$$

In a particular embodiment of the invention, the relationship shown below is employed:

$$OSLB_n = OSLB_{n-1} - INT[\Delta B_n * r^{xB}) + \Delta E^B{}_{n-1}] + q_2(-1)^{n+1};$$

$$\Delta E_n^{B'} = FRAC[(\Delta B_n * r^{xB}) + \Delta E^B{}_{n-1}]$$

where the parameters have the values previously defined and $q_2$ is a positive integer constant. The foregoing pair of equations define up-dating the integer and fractional portions of speed limit changes in the event that the segment length is not decremented below its limit. In the event that, on a particular cycle, the segment length is decremented below the limit ($\sigma$), then an intermediate speed limit profile ($OSLB_n'$) is determined as follows:

$$OSLB_n' = OSLB_{n-1} - INT[(\Delta B_n - \Delta R^B) * r^{xB} + \Delta E_{n-1}{}^B].$$

The unused portion of the distance travelled ($\Delta R^B$) is then used after the new segment length (X+1) is accessed to further up-date the temporary speed limit profile for this particular cycle as follows:

$$OSLB_n = OSLB_n' - INT[(\Delta R^{B*} r^{(x+1)B} + \Delta E_n{}^{B'}] + q_2(-1)^{n+1};$$

$$\Delta E_n^{B'} = FRAC](\Delta B_n - \Delta R^B) * r^{xB} + \Delta E_{n-1}{}^B].$$

Referring back now to FIG. 5*d*, an example of diversity checking is employed at step 74*a*–74*c*. Notwithstanding the fact that the absolute tachometer counts in the two channels may be quite different, the difference between the change in tachometer counts within a single cycle should be within a certain bound $\epsilon$. The check performed via steps 74*a*–74*c* is predicated on this basis. Accordingly, once step 74 has determined $\Delta A_n$ and $\Delta B_n$, then step 74*a* can compare these two quantities. Step 74*b* determines if the difference between $\Delta A_n$ and $\Delta B_n$ is greater or less than some predetermined threshold ($\epsilon$). A difference greater than $\epsilon$ may indicate a failed or erratic tachometer pick-up, a wheel-slide, or a temporary out-of-tolerance condition. Since any of these conditions are a potential hazard. In the event the difference, in any cycle, between $\Delta A_n$ and $\Delta B_n$ is greater than the threshold ($\epsilon$), step 74*b* branches to step 81 to terminate the profile generation process. On the other hand, assuming the difference is less than $\epsilon$ then step 74*c* increments the lesser of the two ($\Delta A_n$ or $\Delta B_n$) by the difference determined in step 74*a*, so as to bring the two quantities into coincidence.

Accordingly, and assuming the profile generation process is not terminated at step 74*b*, then steps 75 et seq. in operating to up-date the segment length and profile speed limit, do so in the two channels with identical changes in the tachometer count.

Because of the relationship between $\Delta A_n$, $\Delta B_n$, and the manner in which the segment length parameter is up-dated ($R_n^{xB}$ and $R_n^{xA}$) the relationship between these parameters in any cycle, assuming proper processing is shown below:

$$R_n^{xB} = R_n^{xA} + \sigma^Y + q_1(-1)^n.$$

Figure 5G:
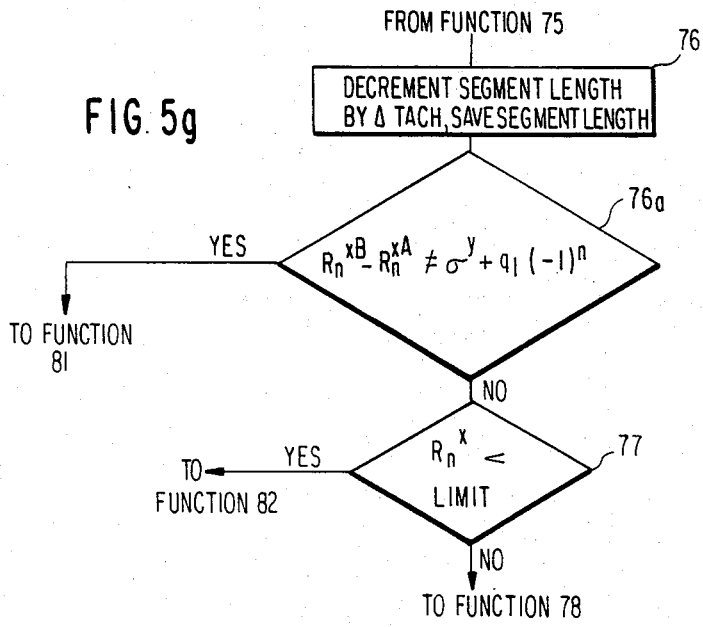

Note in this regard, because of the $(-1)^n$ factor that the difference for example between the remaining segment length in the A and B channels will differ in even and odd cycles. This relationship can be employed, following step 76, to again check proper processing. FIG. 5*g* shows such alternate processing for steps 76, 76*a* and 77. Subsequent to effecting step 76, the difference between $R_n^{xB}$ and $R_n^{xA}$ can be determined, and this difference can be compared to the expected relationship (step 76*a*). If the difference does not show the expected relationship the vital profile generation process can be terminated at this point. Because the relationship is expected to cycle, a stuck-on or stuck-off condition will not allow an unsafe process to continue.

The result of the processing shown in FIG. 5*d* is generation of an up-dated speed limit, $OSLA_n$ and $OSLB_n$, in the A and B channels, respectively.

Because of the processing relationship between the input parameter and the original data derived from the tables, a validating process can be performed on the A and B channels speed limit values in any cycle. In some embodiments of the invention, where all the processing is carried out in a single procesor, the validation process is handled by a different module, for example one that interfaces between the profile speed limit generation step and the governor step. In other embodiments of the invention wherein the profile generator function is effected in a processor which is physically separate from the processor in which the governor function is effected, then the speed limit validation check, which is to be explained, can be carried out in the governor.

The relationship, in any cycle, between the A and B channel speed limits is as indicated below, wherein the difference therebetween is defined as $\Delta OSL_n$:

$$\Delta OSL_n = OSLB_n - OSLA_n = \sigma^Y + q_2(-1)^{n+1}.$$

Figure 5F:
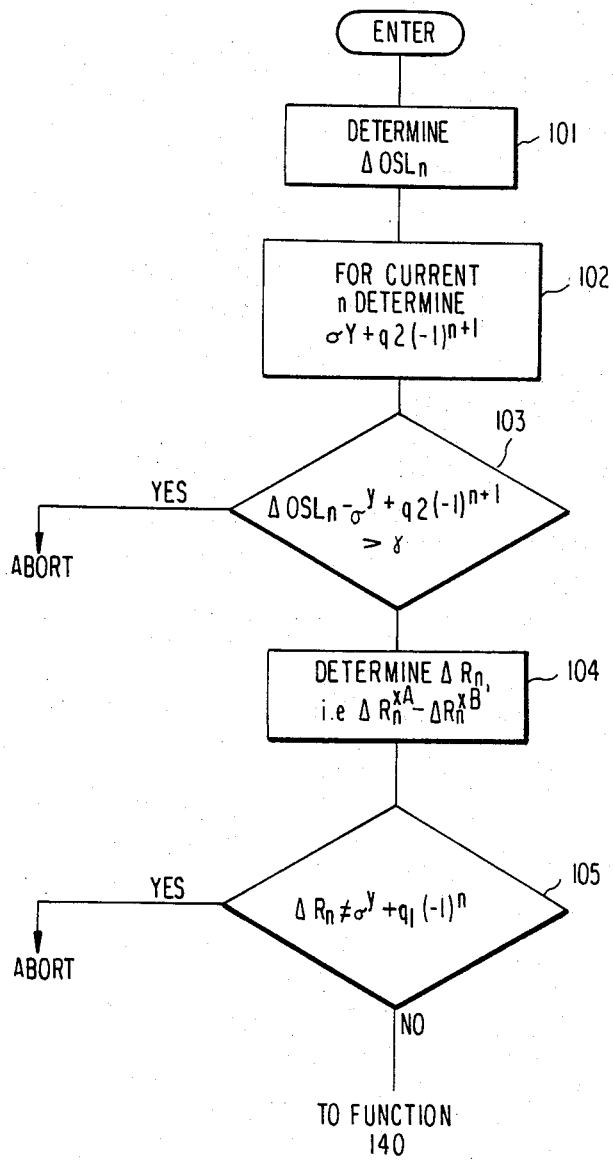

The foregoing processing is illustrated in flow diagram form in FIG. 5*f* as comprising steps 101–103.

In addition, and as shown in steps 104–105 a check is made on $\Delta R_n$. Accordingly, the processing of FIG. 5*f* can be carried out on data transmitted from the profile generator processor to the governor processor, and as implied by FIG. 5*f* the data transmitted from one processor to the other includes the current speed limit calculated in both channels along with the remaining segment length calculated in both channels. Effecting the processing of FIG. 5*f* in the governor processor thus assures that not only is the profile processor operating correctly, but that the data transmitted to the governor processor has not been corrupted in transmission.

To ensure that the various relationships as expressed above are maintained, the input data, i.e. the information extracted from the two tables, must bear an appropriate relationship. In general:

$$R_{\emptyset}^{xB}=f_{b2}(R_{\emptyset}^{xA}, Y).$$

This equation is generic, in one specific embodiment of the invention, that relationship is:

$$R_{\emptyset}^{xB}=R_{\emptyset}^{xA}+\sigma^{Y},$$

where $\sigma^{Y}$ is a positive integer and different for each different one of the potential Y wheelwear conditions.

Furthermore, the rate relationship in the A and B channels must also be related; for example:

$$r^{xB}=F_{b3}(r^{xA}).$$

In a specific embodiment of the invention, a relatively simple relationship between these rates is:

$$r^{xB}=r^{xA}.$$

Three more relationships are required, a relationship between the A and B inital speed limit representations; for example:

$$OSLB_{\emptyset}=OSLA_{\emptyset}+\lambda^{Y},$$

where $\lambda^{Y}$ is a positive integer, unique for each different wheelwear condition.

In order to access the tables, the processor must be able to use input information corresponding to the initial speed limit values in the A and B channels to access the appropriate table, therefore:

$$R_{\emptyset}^{xA}PTR=F_{a1}(OSLA_{\emptyset});\ R_{\emptyset}^{xB}PTR=F_{b1}(OSLB_{\emptyset}),$$

where $R_{518}{}^{xA}$ PTR, and $R_{\emptyset}^{xB}$ PTR are respectively addresses or pointers to the first table entry corresponding to the A and B speed limit values $OSLA_{\emptyset}$ and $OSLB_{\emptyset}$.

From the preceding description it should be apparent that the invention provides, on board a vehicle, for the initiation of a profile generation process. In the course of the process, a sequence of speed limits are generated which are in excess of the speed limit generated by wayside circuitry, inasmuch as profile generation terminates in the event that the profile generated speed limit is equal to or less than the wayside generated speed limit. The vehicle governor is modified to inhibit or prevent brake application or brake application requirements so long as actual vehicle speed is below profile speed, notwithstanding the fact that it may be actually in excess of wayside generated speed limits. Since the vehicle is allowed to travel at or below a speed limit generated on board the vehicle (for which the safety provisions of the wayside generating circuitry are inapplicable) safety considerations are respected by applying principles of diversity and cycle checking. Diversity is applied at a number of points in the processing to ensure that two different parallel processes take place, and the results accepted only if the relationship between the results of those processes bear the expected relationship. Cycle checking is implemented, for example, by requiring the relationship to change from cycle to cycle, and not merely validating a result based on a fixed relation between results in the two processes.

In initiating profile generation, potentially unsafe conditions caused by a spurious initiation of profile the processing from an incorrectly determined high speed limit, is prevented by requiring the speed limit from which profile begins to have been present for a sufficiently long time to ensure that spurious detection of such a condition is expected at a vanishingly small probability. Diversity is also applied by making this check on the validity of the speed limit from which a profile has begun, on two different sets of data, and requiring both processes to agree before allowing the initiation of a profile.

Diversity is again applied by providing for two different processes, each generating a profile speed limit. The data used in the two different processes are different although representing identical real world parameters. The two significant parameters of remaining length in a segment and profile speed limit in a cycle are both validated by comparing the results in both processes. The change in remaining length ($\Delta A_n$ or $\Delta B_n$) in both processes must agree to within some small threshold, and after agreement is indicated, correction is effected to prevent unnecessary termination of the profile generation process by repeated build-up of small errors. Thus, the remaining length $A_n$ and $B_n$ must show the expected relationship. The profile speed limits generated by the two different processes are compared for a relationship, but cycle checking is applied to this relationship in that the relationship itself cycles. Only after all the tests are passed are the profile speed limits accepted and acted on. If any of the tests are failed, profile generation terminates and the wayside imposed speed limit is effective.

In implementing the processing, the different coding of the data in the two channels ensures that the data in one channel cannot be mistakenly used in another channel. In addition, pointers used in accessing data from tables is only temporarily stored to prevent inaccurate table accesses.

Those skilled in the art will be aware that various changes and modifications can be made to the invention without departing from the spirit and scope of the invention. For example, various specific relationships have been described, and it should be understood those are merely exemplary. In terms of physically implementing the invention, various types of discrete logic or random logic processors can be employed, with wide latitude in distributing the logic on one, two or more separate processing units. In view of the foregoing, the scope of the invention is to be determined from the following claims.

We claim:

1. Vehicle carried control apparatus to control vehicle motion in the transition from a first speed limit to a second, lower, speed limit, comprising:

signal receiving means for receiving and registering wayside imposed speed limits, vehicle speed measuring means for producing a signal representative of vehicle speed, governor means responsive to said signal receiving means and to said vehicle speed measuring means for imposing a braking force or a requirement for a braking operation on said vehicle if said vehicle speed is greater than said wayside imposed speed limit, wherein the improvement comprises:

speed profile generating means responsive to said signal receiving means receiving a second speed limit at a time when a first higher speed limit had been effective to generate a speed limit profile, monotonically decreasing from said first toward said second speed limit, and means to withhold application of said braking force or requirement so long as said speed limit profile is generated and said vehicle speed is less than a current value of said speed limit profile.

2. The apparatus of claim 1 wherein said speed profile generating means includes:

first and second speed limit sequence generating means for generating first and second speed limit sequences, respectively, each of said sequences consisting of a time sequence of speed limits, decreasing monotonically with respect to time elapsed or distance travelled, comparison means for comparing corresponding first and second speed limits for detecting a relationship therebetween, said comparison means terminating operation of said speed profile generating means unless said relationship corresponds to a specified relation.

3. The apparatus of claim 2 wherein said comparison means terminates operation of said speed profile generating means unless said relationship cycles between a first and second relationship.

4. The apparatus of claim 1 wherein said speed profile generating means includes:

first and second processors for generating first and second sequences of speed limits, each said processor operating iteratively to reduce a speed limit representation, checking means associated with both said processors for comparing corresponding representations of said speed limits for terminating operation of said speed profile generating means in the event said representations differ.

5. The apparatus of any of claims 1–4 in which said speed profile generating means includes a speed limit initiating means for initiating operation of said speed profile generating means, said speed limit initiating means comprising means to compare a current wayside speed limit with a prior wayside speed limit, and timing means to determine the duration of time over which a wayside imposed speed limit is unchanged, said speed limit initiating means initiating operation of said speed profile generating means in response to a transition in wayside imposed speed limits from a higher speed limit, received unchanged for at least a duration T, to a lower wayside imposed speed limit.

6. A transitional speed limit generator responsive to a pre-existing speed limit and to signals indicative of vehicle travel for generating a series of transitional speed limits comprising:

first tachometer channel means for producing signals indicative of vehicle travel, first processor means for generating a first time series of transitional speed limits in response to said first tachometer channel means, second tachometer channel means for producing signals indicative of vehicle travel, second processor means for generating a second time series of transitional speed limits in response to said second tachometer channel means, comparison means for comparing each transitional speed limit of said first series with a corresponding transitional speed limit from said second series to validate said transitional speed limit of said first series, but only if a relationship between sequential pairs of speed limits from said first and second series cycles between a first and a second relation.

7. The apparatus of claim 6 which includes:

decoding means exclusively associated with said second tachometer channel means for operating on an output thereof to produce decoded input signals for said second processor means, said first and second processor means including first and second differencing means for generating a first and second series of differences between inputs from said tachometer channel means, said comparison means including differencing comparing means for comparing corresponding differences from said first and second series of differences for terminating operation of both said processor means unless corresponding first and second differences exhibit a predetermined relation to each other.

8. A machine implemented process for generating a monotonically decreasing output signal between first upper and second lower limits as a function of a monotonically changing input function, with:

input means responsive to said input function for generating first and second machine inputs comprising a first machine input directly representing said input function and a second machine input representing a coded representation of said input function, further input means for registering said first and second limits, and digital computer means responsive to said input and further input means for generating said output, said digital computer means performing the function of establishing a sequence of operation periods, performing a first process including registering said first limit and said first machine input, and for thereafter, registering said first machine input once per operation period, reducing said registered first limit by a quantity related to the difference between said first machine input at the beginning and end of each operation period, performing a second process including registering said first limit, registering, once per operation period, a decoded representation of said second machine input, forming a second processor difference representing the difference between said decoded second machine input at the beginning and end of said operation period, reducing said registered first limit by an amount related to said second processor difference, and once per operation period comparing a reduced first limit from both said first and second processes and for inhibiting said first and second processes unless said reduced limits bear a specified relation to each other, and outputting said first limit from one of said processes as said output unless said comparing step inhibits said processes.

9. The method of claim 8 which further includes:

terminating operation of both said processes when said second limit exceeds a selected one of said reduced limits.

10. The method of claim 8 in which:

said first process includes forming a first process difference representing the difference between said first machine input at the beginning and end of each operation period, said second process includes forming a second process difference representing the difference between said second machine input at the beginning and end of each operation period, and the further step of checking said first process difference and said second process difference and for inhibiting said processes unless said differences bear a predetermined relation.

11. The method of claim 8 in which said comparing step inhibits said processes unless said relation alternates between a first and a second relation.

12. A vehicle carried control apparatus especially suited for governing vehicle travel in a transition from a first to a second, lower, speed limit comprising:

signal receiving means responsive to wayside speed limit signals for registering the same including an "old" speed limit register for registering an "old" speed limit in response to a "new" lower speed limit, means responsive to receipt of a "new" lower speed limit for initiating a speed profile generation process, a tachometer, first and second counters each including output circuits, means incrementing said counters in response to said tachometer, control means responsive to said signal receiving means and to said counter output circuits to generate and validate a time series of profile speed limits between said first and second speed limits, said control means comprising:

two groups of registers, each group including speed limit, tachometer, segment length, rate and pointer registers, a plurality of common working registers, a pair of table means, each for storing and accessing an entry for a plurality of "old" speed limits, each entry including representations for segment length, rate and pointer, table accessing means responsive to initiation of a speed profile generation process for reading said tables corresponding to a registered "old" speed limit, means for copying said representations of segment length and "old" speed limits to corresponding registers in both said groups, first means for periodically forming differences between signals provided by said counter output circuits and contents of said segment length registers and for storing said differences sequentially into said common working registers, means responsive to said first means for forming a velocity increment by multiplying a difference and a corresponding rate, means for reducing said limit register by said velocity increment, means for replacing contents of said segment length register with said signals provided by said counter output cirucit, and final means for controlling vehicle speed based on contents of said speed limit register.

13. The apparatus of claim 12 in which said control means further includes validation means inhibiting operation of said final means unless a difference between contents of said two speed limit registers exhibits a predetermined relation.

14. The apparatus of claim 13 in which said validation means requires said difference to alternate between two quantities, otherwise operation of said final means is inhibited.

15. The apparatus of claim 12 in which said control means further includes checking means continually comparing changing contents of said pair of segment length registers, said checking means terminating said profile generation process unless contents of said pair of segment length registers are equal.

16. The apparatus of claim 15 in which said checking means includes means to compare said differences and to inhibit operation of said final means if said differences differ from each other by more than a predetermined quantity, and to adjust one of said two differences, if they differ by less than said predetermined quantity to bring said differences into coincidence.

17. The apparatus of claim 12 in which said table accessing means is responsive to a selected one of said common registers to the exclusion of any of said groups of registers for addressing either of said table means.

* * * * *